US010849371B2

(12) United States Patent
Takahisa

(10) Patent No.: US 10,849,371 B2
(45) Date of Patent: Dec. 1, 2020

(54) BLIND FOR SKIRT

(71) Applicant: Tsutomu Takahisa, Tokyo (JP)

(72) Inventor: Tsutomu Takahisa, Tokyo (JP)

(73) Assignee: Tsutomu Takahisa, Tokyo (JP)

( * ) Notice: Subject to any disclaimer, the term of this patent is extended or adjusted under 35 U.S.C. 154(b) by 144 days.

(21) Appl. No.: 16/321,648

(22) PCT Filed: Jul. 28, 2017

(86) PCT No.: PCT/JP2017/027416
§ 371 (c)(1),
(2) Date: Jan. 29, 2019

(87) PCT Pub. No.: WO2018/021524
PCT Pub. Date: Feb. 1, 2018

(65) Prior Publication Data

US 2019/0343196 A1 Nov. 14, 2019

(30) Foreign Application Priority Data

Jul. 29, 2016 (JP) ..... 2016-150790

(51) Int. Cl.

| | |
|---|---|
| ***A41D 1/14*** | (2006.01) |
| ***A41D 27/12*** | (2006.01) |
| ***A41D 1/22*** | (2018.01) |
| ***A41D 27/04*** | (2006.01) |

(52) U.S. Cl.
CPC ..... *A41D 1/14* (2013.01); *A41D 27/12* (2013.01); *A41D 1/22* (2013.01); *A41D 27/04* (2013.01); *A41D 2300/32* (2013.01); *A41D 2300/52* (2013.01)

(58) Field of Classification Search
CPC ..... A41D 1/14; A41D 27/12
USPC ..... 2/221, 46
See application file for complete search history.

(56) References Cited

U.S. PATENT DOCUMENTS 1,201,860 A * 10/1916 Nelke ..... A41B 9/08 2/78.2
1,238,686 A * 8/1917 Kimball ..... A41D 1/14 2/212
1,616,440 A * 2/1927 Cohen ..... A41B 9/08 2/73

(Continued)

FOREIGN PATENT DOCUMENTS

JP H03-25510 U 3/1991
JP H10-259512 A 9/1998

(Continued)

OTHER PUBLICATIONS

ISA/JP, International Search Report dated Oct. 24, 2017 in International Application No. PCT/JP2017/027416, Total 2 pages.

*Primary Examiner* — Gloria M Hale
(74) *Attorney, Agent, or Firm* — Masuvalley & Partners

(57) ABSTRACT

A blind 1 for a skirt integrally includes: a V-shaped portion 20 folded along a first folding line 11 and formed so as to extend along right and left thighs; a blind portion 30 folded along right and left second folding lines 12, 12 tilted relative to the first folding line 11 of the V-shaped portion 20 to shield a space formed between the V-shaped portion 20; and right and left attachment portions 40, 40 formed to be continuous with the V-shaped portion 20 and attached to a skirt.

13 Claims, 7 Drawing Sheets

(56) References Cited

U.S. PATENT DOCUMENTS

| | | | | | |
|---|---|---|---|---|---|
| 1,808,614 | A | * | 6/1931 | Stein | A41B 9/08 2/46 |
| 3,066,308 | A | * | 12/1962 | Erteszek | A41B 9/10 2/212 |
| 3,399,679 | A | * | 9/1968 | Barg | A41B 9/08 450/95 |
| 4,106,125 | A | * | 8/1978 | Palumbo | A41D 15/02 2/213 |
| 5,566,392 | A | * | 10/1996 | Dzelzkalns | A41B 9/08 2/73 |
| 5,864,891 | A | * | 2/1999 | Gonzales | A41B 9/10 2/400 |

FOREIGN PATENT DOCUMENTS

| | | | |
|---|---|---|---|
| JP | 2004-092001 | A | 3/2004 |
| JP | 3190443 | U | 5/2014 |

* cited by examiner

BLIND FOR SKIRT

RELATED APPLICATIONS

This application is the U.S. National Phase of and claims priority to International Patent Application No. PCT/JP2017/027416, International Filing Date Jul. 28, 2017; which claims benefit of Japanese Patent Application No. 2016-150790 filed Jul. 29, 2016; both of which are incorporated herein by reference in their entireties.

TECHNICAL FIELD

The present invention relates to a blind for a skirt for preventing exposure of underwear or the like from a space between thighs, when a person wearing a skirt sits in a seiza style (sits on one's heels) or sits in a chair or the like.

BACKGROUND ART

Heretofore, women have often worn above-knee length miniskirts and dresses having short above-knee length skirt portions to dress fashionably.

However, there has been a problem that underwear or the like is exposed from a space between thighs, when the person wearing such a short skirt sits in a seiza style or sits on a chair or the like.

To solve such a problem, for example, Patent Literature 1 discloses a blind for a skirt that shields the part between the legs from the outside by providing a bag-like conical blind on a center inner face of a skirt, providing a plate in a part of an end edge of an opening, and hanging an end of a chain from a center part of the plate to an inner wall bottom part.

CITATION LIST

Patent Literature

[Patent Literature 1] Japanese Patent Laid-Open No. 10-259512

SUMMARY OF INVENTION

Technical Problem

However, the conventional technique disclosed in Patent Literature 1 has problems that the blind does not necessarily come to an appropriate position in many cases depending on the person wearing the skirt, and that even after sweating after wearing, nothing can be done until the whole skirt is cleaned.

Hence, an objective of the present invention is to provide a blind for a skirt that can be used by anyone wearing the skirt, can be brought to a preferred comfortable position, and can be replaced immediately even after sweating during use.

Solution to Problem

To achieve the objective, a blind for a skirt of the present invention is configured of a flat sheet material, and integrally includes: a V-shaped portion folded along a first folding line and formed so as to extend along right and left thighs; a blind portion folded along right and left second folding lines tilted relative to the first folding line of the V-shaped portion to shield a space formed between the V-shaped portion; and right and left attachment portions formed to be continuous with the V-shaped portion and attached to a skirt.

The blind of a skirt of the present invention is configured of a flat sheet material, and integrally includes: a V-shaped blind portion folded along a first folding line and formed into a V shape so as to extend along right and left thighs, and also folded along right and left second folding lines tilted relative to the first folding line to shield a space formed between the V shape; and right and left attachment portions formed to be continuous with the V-shaped blind portion and attached to a skirt.

Here, "skirt" referred to in the present invention not only includes a simple skirt, but also a dress and a one-piece dress having a skirt portion. That is, the present invention is applicable to any clothing having a structure where underwear may be visible from the front in a sitting state. Moreover, the present invention is also applicable to clothing having a structure where underwear is not actually visible.

Advantageous Effects of Invention

Since the blind for a skirt of the present invention is configured in the above manner, the blind can be attached and detached to and from a center inner face of a skirt. Hence, the blind can be used by anyone wearing the skirt, and the blind can be placed in any desired position. Also, the blind can be replaced immediately when the user sweats during use. Moreover, the blind is hidden in a standing state, and forms a blind in a sitting state. The blind for a skirt also appears natural when viewed from the front in an attached state.

DESCRIPTION OF EMBODIMENTS

Figure 1:
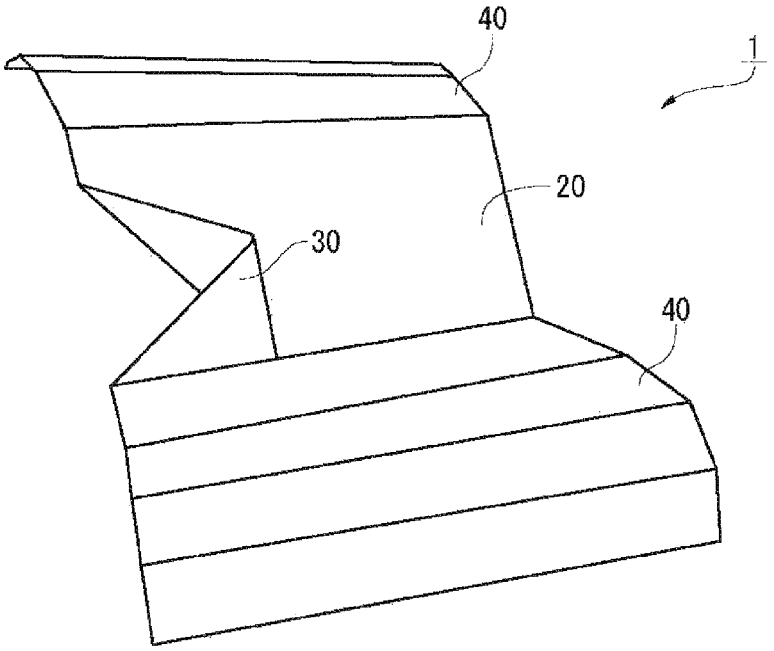
FIG. 1 is a perspective view of a blind for a skirt of Example 1.

Hereinafter, embodiments of the present invention will be described on the basis of Examples 1 to 3 shown in the drawings.

Example 1

(Configuration)

Figure 2:
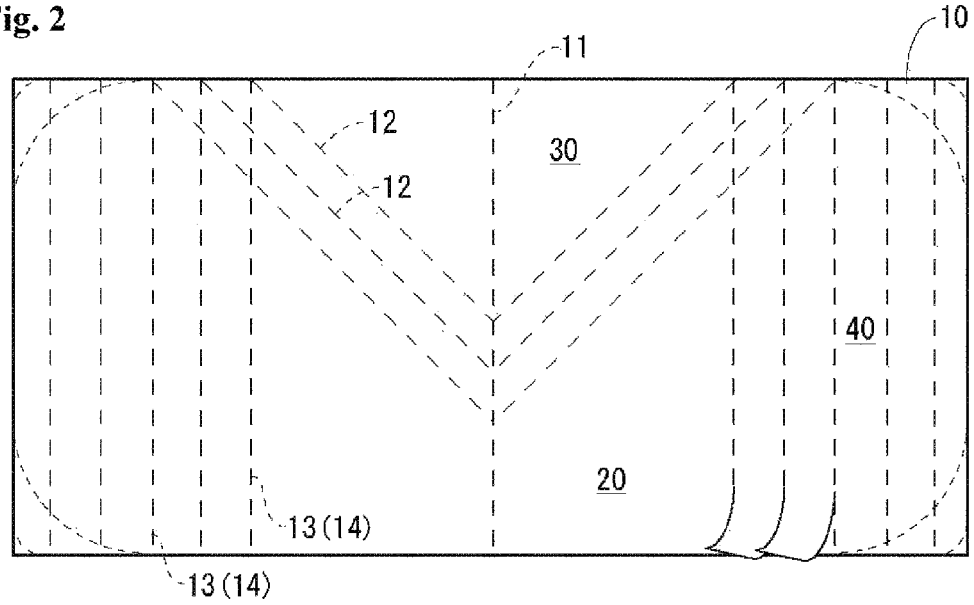
FIG. 2 is a plan view of the blind for a skirt of Example 1.

First, a configuration of Example 1 will be described with reference to FIGS. 1 to 3. A blind 1 for a skirt of Example 1 is configured in a three-dimensional manner by folding a single rectangular sheet material along some folding lines (or perforations). Specifically, as shown in FIGS. 1 and 2, the blind 1 for a skirt is configured of a sheet material 10 including chemical fiber such as acryl, polyester, and nylon, natural fiber such as cotton and hemp, nonwoven fabric, felt, Japanese paper, foreign paper, or the like. The blind 1 for a skirt integrally includes: a V-shaped portion 20 folded along a first folding line 11 formed at the substantial center of the flat sheet material 10 and formed so as to extend along right and left thighs; a blind portion 30 folded along right and left second folding lines 12, 12 tilted relative to the first folding line 11 of the V-shaped portion 20 to shield a space formed between the V-shaped portion 20; and right and left attachment portions 40, 40 formed to be continuous with the V-shaped portion 20 and attached to a skirt.

The V-shaped portion 20 is formed by valley-folding (top view) the rectangular sheet material 10 along the first folding line 11 at the substantial center of both right and left sides. That is, the V-shaped portion 20 is formed into a V shape by folding the material 10 in the manner of "square fold (orihon basic fold)" in origami. Since the V-shaped portion 20 is positioned along the inner sides of both legs when the blind 1 is attached to a skirt S, the fold angle of the first folding line 11 is adjusted so as to cover a space surrounded by both legs and the skirt S. Note that as will be mentioned later, a region near the first folding line 11 is referred to as the V-shaped portion 20, and regions away from the first folding line 11 are referred to as the attachment portions 40, 40.

The blind portion 30 is valley-folded (top view) along the symmetrical second folding lines 12, 12 tilted relative to the first folding line 11 of the V-shaped portion 20 to be folded back to the space formed between the V-shaped portion 20, and thereby shields the space from being seen from the front (direction along first folding line 11). That is, the blind portion 30 is formed by creasing (second folding lines 12, 12) the material 10 and pushing inward, in the manner of "inside reverse fold" in origami. Note that the tilt angle of the symmetrical second folding lines 12, 12 relative to the first folding line 11 is not particularly limited, but is preferably 30 to 60 degrees, and may be 45 degrees, for example.

As described above, the blind portion 30 is formed by pushing the V-shaped portion 20 inward from the second folding lines 12, 12. By forming multiple second folding lines 12, 12 according to positions of the later-described attachment portions 40, 40, blind portions 30 of different sizes can be formed according to need. Specifically, the second folding line 12 is formed in three different positions, for example, and can adjust the size of the blind portion 30 to three levels.

The attachment portions 40, 40 are formed into right and left wing shapes (top view) continuous with the V-shaped portion 20, by mountain-folding both sides of the V-shaped portion 20 along third folding lines 13, 13 parallel to the first folding line 11. As will be described later, the V-shaped portion 20 (and blind portion 30) and the attachment portion 40 are interchangeable depending on the position of the selected third folding line 13.

The right and left attachment portions 40, 40 have an adhesive and a release paper covering the face on which the adhesive is applied. The release paper is a single piece or is divided into multiple regions, so that the region where the release paper is not peeled is also usable as the V-shaped portion 20. In other words, by folding the material 10 at an end portion of the region where the release paper is peeled and forming the third folding line 13, parts near both ends can be used as the attachment portions 40, 40, and a part near the center can be used as the V-shaped portion 20 (and blind portion 30).

The right and left attachment portions 40, 40 are divided into multiple regions by one or multiple perforations 14, . . . , and the attachment portion 40 is removable along the perforations 14. That is, since the perforations 14, . . . are provided according to the divided release paper regions, unnecessary parts can be removed.

Figure 3:
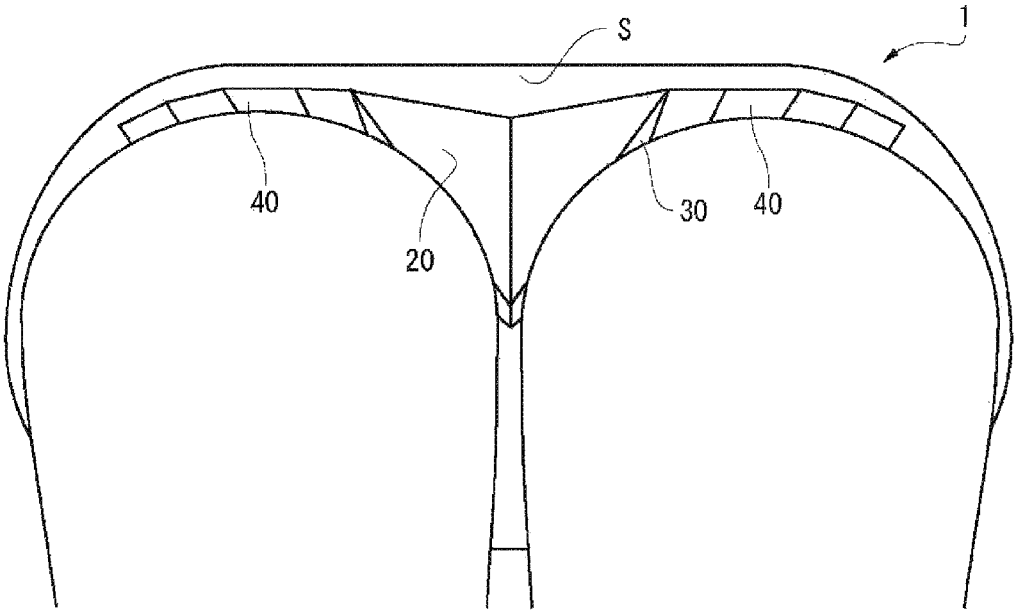
FIG. 3 is a front view of a sitting state where the blind for a skirt of Example 1 is attached.

As shown in FIG. 3, the attachment portion 40 can be attached and detached to and from a center inner face (close to lower side of center of front face) of the skirt S. The attachment position of the attachment portion 40 on the skirt S is preferably on a substantial center line in the right-left direction of the front face, and a position that is not exposed from the end of the skirt S. The attachment position in the up-down direction may be selected according to need.

(Effects)

Next, effects of the blind 1 for a skirt of Example 1 will be listed.

(1) The blind 1 for a skirt of Example 1 described above is configured by folding the flat sheet material 10, and integrally includes: the V-shaped portion 20 folded along the first folding line 11 and formed so as to extend along right and left thighs; the blind portion 30 folded along the right and left second folding lines 12, 12 tilted relative to the first folding line 11 of the V-shaped portion 20 to shield a space formed between the V-shaped portion 20; and the right and left attachment portions 40, 40 formed to be continuous with the V-shaped portion 20 and attached to a skirt.

With the above configuration, the blind 1 can be attached and detached to and from the center inner face of the skirt S. Hence, the blind 1 can be used by anyone wearing the skirt S, and the blind 1 can be placed in any desired position.

Additionally, by varying the distance between the attachment portions 40, 40 and the relative angle (degree of opening) between the attachment portions 40, 40 according to need of the user, the height (depth), width, length, and the like of the blind portion 30 can be varied freely. Hence, the blind 1 can be changed into and adapted to various shapes in a single form.

In addition, the attachment portion 11 can be attached multiple times. Since the blind 1 can be replaced immediately when the user sweats during use, for example, odor is less likely to stick to the blind 1, skin disease is less likely to occur, and the blind 1 can be kept clean.

Moreover, since all of the used materials are inexpensive, the blind 1 can be mass-produced as a disposable and inexpensive product. Further, the blind 1 is hidden in a standing state, and forms a blind in a sitting state.

In the present invention, the blind 1 for a skirt appears natural in an attached state when viewed from the front. That is, since the center part of the blind portion 30 is recessed in front view, it appears like flare pants or a petticoat, and a natural look can be maintained.

Furthermore, since the blind 1 is formed by folding the flat sheet material 10, production is easy and various materials are usable. Hence, the blind 1 is inexpensive, easy to carry, and is therefore easily changeable.

(2) Additionally, the right and left attachment portions 40, 40 have an adhesive and a release paper covering the face on which the adhesive is applied. The release paper is a single piece or is divided into multiple regions, so that the region where the release paper is not peeled is also usable as the V-shaped portion 20. Hence, sizes of the attachment portion 40 and the V-shaped portion 20 can be adjusted according to the body size and preferences.

(3) Furthermore, the right and left attachment portions 40, 40 are divided into multiple regions by one or multiple perforations, and the attachment portion 40 is removable along the perforations. Hence, by cutting off and removing unnecessary parts, a light and simple blind 1 can be obtained.

Example 2

Next, Example 2 will be described with reference to FIGS. 4 to 6. Note that descriptions of parts same or similar to those of Example 1 are given by assigning the same reference numerals.

(Configuration)

A blind 1A for a skirt of Example 2 is configured in a three-dimensional manner by folding a single isosceles (right) triangle sheet material 10 along some folding lines (or perforations). Specifically, as shown in FIGS. 4 and 5, the blind 1A for a skirt is configured of the sheet material 10 including chemical fiber such as acryl, polyester, and nylon, natural fiber such as cotton and hemp, nonwoven fabric, felt, Japanese paper, foreign paper, or the like. The blind 1A for a skirt integrally includes: a V-shaped blind portion 50 folded along a first folding line 11 formed at the substantial center of the flat sheet material 10 and formed into a V shape so as to extend along right and left thighs, and also folded along right and left second folding lines 12, 12 tilted relative to the first folding line 11 to shield a space formed between the V shape; and right and left attachment portions 60, 60 formed to be continuous with the V-shaped blind portion 50 and attached to a skirt.

The V-shaped blind portion 50 is formed by valley-folding (top view) the isosceles (right) triangle sheet material 10 along the first folding line 11 at the substantial center of right and left equal sides. The V-shaped blind portion 50 is formed into a V shape by folding in half and opening the material 10. Since the V-shaped blind portion 50 is positioned along the inner sides of both legs when the blind 1 is attached to a skirt S, the fold angle of the first folding line 11 is adjusted so as to cover a space surrounded by both legs and the skirt S. Note that as will be mentioned later, a region near the first folding line 11 is referred to as the V-shaped blind portion 50, and regions away from the first folding line 11 are referred to as the attachment portions 60, 60.

Note that the tilt angle of the symmetrical second folding lines 12, 12 relative to the first folding line 11 is not particularly limited, but is preferably 30 to 60 degrees, and may be 45 degrees, for example. Additionally, by forming multiple second folding lines 12, 12, V-shaped blind portions 50 of different sizes can be formed according to need. Specifically, the second folding line 12 is formed in three different positions, for example, and can adjust the height and width of the V-shaped blind portion 50 to three levels.

The attachment portions 60, 60 are formed into right and left wing shapes continuous with the V-shaped blind portion 50, by mountain-folding (top view) both sides of the V-shaped blind portion 50 along the second folding lines 12, 12. As will be described later, the V-shaped blind portion 50 and the attachment portions 60, 60 are interchangeable depending on the position of the selected second folding line 12.

The right and left attachment portions 60, 60 have an adhesive and a release paper covering the face on which the adhesive is applied. The release paper is a single piece or is divided into multiple regions, so that the region where the release paper is not peeled is also usable as the V-shaped blind portion 50. In other words, by folding the material 10 at an end portion of the region where the release paper is peeled and forming the second folding line 12, parts near both ends can be used as the attachment portions 60, 60, and a part near the center can be used as the V-shaped blind portion 50.

The right and left attachment portions 60, 60 are divided into multiple regions by one or multiple perforations 14, . . . , and the attachment portion 60 is removable along the perforations 14. That is, since the perforations 14, . . . are provided according to the divided release paper regions, unnecessary parts can be removed.

Figure 6:
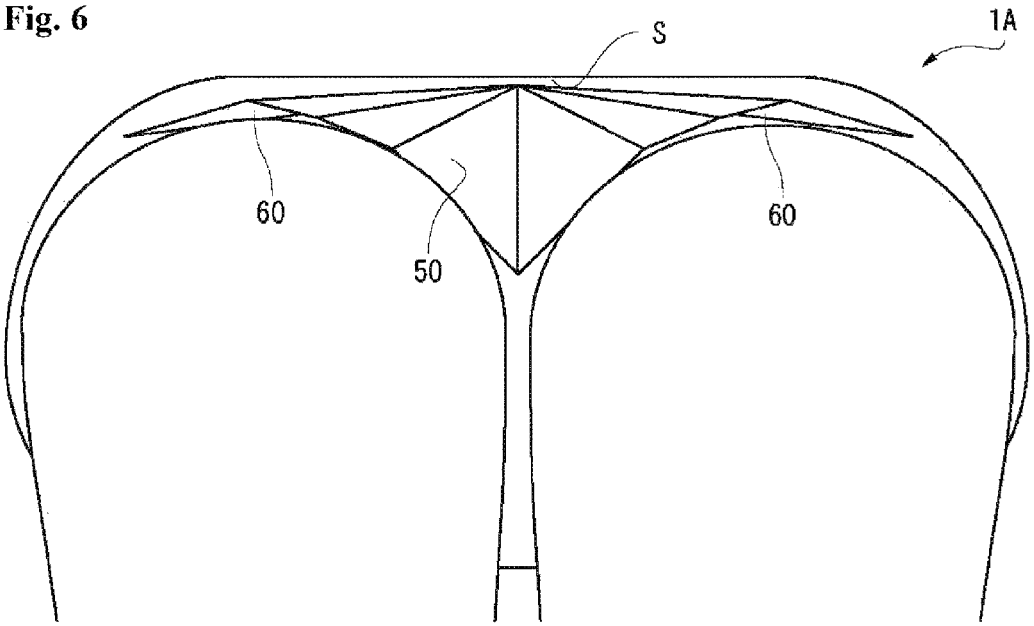
FIG. 6 is a front view of a sitting state where the blind for a skirt of Example 2 is attached.

As shown in FIG. 6, the attachment portion 60 can be attached and detached to and from a center inner face (close to lower side of center of front face) of the skirt S. The attachment position of the attachment portion 60 on the skirt S is preferably on a substantial center line in the right-left direction of the front face, and a position that is not exposed from the end of the skirt S. The attachment position in the up-down direction may be selected according to need.

Moreover, the tip end of the V-shaped blind portion 50 is divided into multiple regions by one or multiple perforations 14, and the tip end is removable along the perforations 14. That is, when the blind 1A is attached to the skirt S, an apex where the equal sides intersect protrudes to the front. By cutting off this part and adjusting size, it is possible to prevent excessive protrusion of the tip end.

(Effects)

Next, effects of the blind 1A for a skirt of Example 2 will be listed.

(1) The blind 1A for a skirt of Example 2 described above is configured of the flat sheet material 10, and integrally includes: the V-shaped blind portion 50 folded along the first folding line 11 and formed into a V shape so as to extend along right and left thighs, and also folded along the right and left second folding lines 12, 12 tilted relative to the first folding line 11 to shield a space formed between the V shape; and the right and left attachment portions 60, 60 formed to be continuous with the V-shaped blind portion 50 and attached to a skirt.

With the above configuration, the blind 1A can be attached and detached to and from the center inner face of the skirt S. Hence, the blind 1A can be used by anyone wearing the skirt S, and the blind 1A can be placed in any desired position.

Additionally, by varying the distance between the attachment portions 60, 60 and the relative angle (degree of opening) between the attachment portions 60, 60 according to need of the user, the height (depth), width, length, and the like of the V-shaped blind portion 50 can be varied freely. Hence, the blind 1A can be changed into and adapted to various shapes in a single form.

In addition, the attachment portion 60 can be attached multiple times. Since the blind 1A can be replaced immediately when the user sweats during use, for example, odor is less likely to stick to the blind 1A, skin disease is less likely to occur, and the blind 1A can be kept clean.

Moreover, since all of the used materials are inexpensive, the blind 1A can be mass-produced as a disposable and inexpensive product. Further, the blind 1A is hidden in a standing state, and forms a blind in a sitting state.

In the present invention, the blind 1A for a skirt appears natural in an attached state when viewed from the front. That is, since the center part of the V-shaped blind portion 50 is recessed in front view, it appears like flare pants or a petticoat, and a natural look can be maintained.

Furthermore, since the blind 1A is formed by folding the flat sheet material 10, production is easy and various materials are usable. Hence, the blind 1A is inexpensive, easy to carry, and is therefore easily changeable.

(2) Additionally, the tip end of the V-shaped blind portion 50 is divided into multiple regions by one or multiple perforations 14, . . . , and the tip end is removable along the perforations 14, . . . . By cutting off the tip end part and adjusting size according to the body size and preferences, it is possible to prevent excessive protrusion of the tip end.

Note that since other configurations and effects are substantially the same as Example 1, descriptions will be omitted.

Example 3

Next, Example 3 will be described with reference to FIGS. 8 to 11. Note that descriptions of parts same or similar to those of Examples 1 and 2 are given by assigning the same reference numerals. Example 3 describes a case where second folding lines extend toward the same one side of a material, instead of extending to different sides of a material as in Example 2.

(Configuration)

Figure 8:
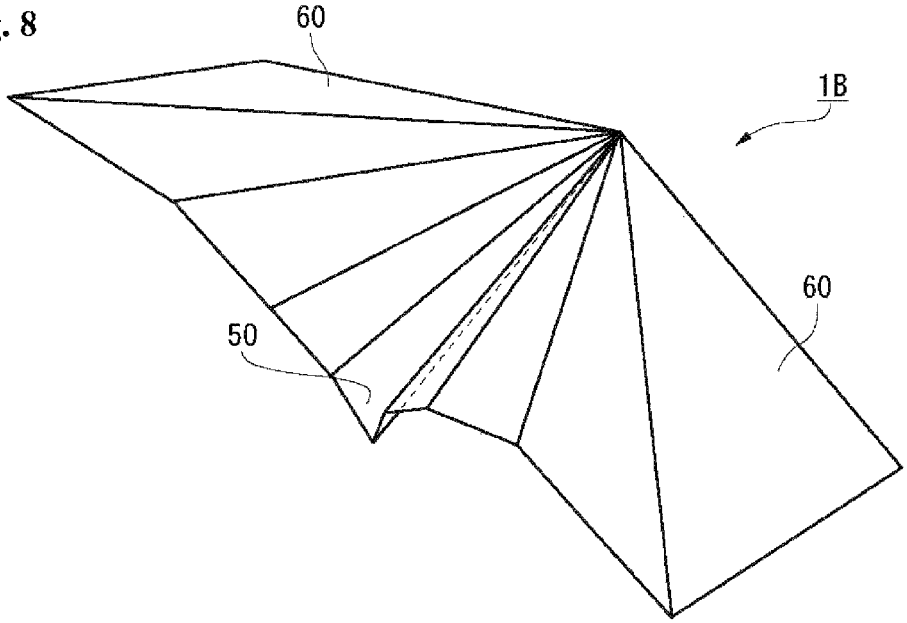
FIG. 8 is a perspective view of a blind for a skirt of Example 3.
Figure 9:
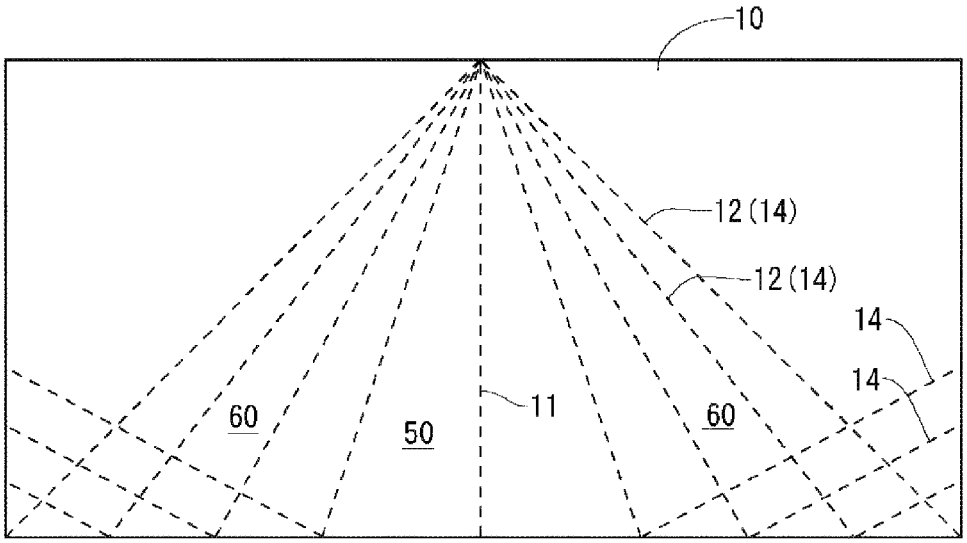
FIG. 9 is a plan view of the blind for a skirt of Example 3.

As shown in FIGS. 8 and 9, a blind 1B for a skirt of Example 3 is configured of a rectangular sheet material 10, and integrally includes a V-shaped blind portion 50, and right and left attachment portions 60, 60. In Example 3, right and left second folding lines 12, 12 extend from an intersection with a first folding line 11 toward the same one side forming the external shape of the flat sheet material.

In other words, first, the first folding line 11 extends from the midpoint of one long side of the rectangular material 10 to the midpoint of the other long side thereof. Then, the second folding line 12 extends radially from the midpoint of one long side which is the intersection with the first folding line 11 toward the other long side. That is, multiple second folding lines 12 extend from the midpoint of one long side to both right and left sides toward the other long side at slightly different tilt angles relative to the first folding line 11. Note that the first folding line 11 need not be formed along a line connecting the midpoints, and may be formed closer to the right or left.

The V-shaped blind portion 50 is formed by valley-folding (top view) the rectangular sheet material 10 along the first folding line 11. Since the V-shaped blind portion 50 is positioned along the inner sides of both legs, the fold angle of the first folding line 11 is adjusted so as to cover a space surrounded by both legs and the skirt.

By forming multiple second folding lines 12, 12, V-shaped blind portions 50 of different sizes can be formed according to need.

The attachment portions 60, 60 are formed into right and left wing shapes continuous with the V-shaped blind portion 50, by mountain-folding (top view) both sides of the V-shaped blind portion 50 along the second folding lines 12, 12. The V-shaped blind portion 50 and the attachment portions 60, 60 are interchangeable depending on the position of the selected second folding line 12.

The right and left attachment portions 60, 60 have an adhesive and a release paper covering the face on which the adhesive is applied. The release paper is a single piece or is divided into multiple regions, so that the region where the release paper is not peeled is also usable (usable) as the V-shaped blind portion 50.

The right and left attachment portions 60, 60 are preferably divided into multiple regions by one or multiple perforations 14, . . . overlapping the positions of the second folding lines 12, and the attachment portion 60 is preferably removable along the perforations 14.

The attachment portion 60 can be attached and detached to and from a center inner face (close to lower side of center of front face) of the skirt. The attachment position of the attachment portion 60 on the skirt is preferably on a substantial center line in the right-left direction of the front face, and a position that is not exposed from the end of the skirt. The attachment position in the up-down direction (front-back direction) may be selected according to need. In this regard, the perforations 14 should preferably be provided so that a part exposed (projecting) from the end of the skirt is removable.

That is, the tip ends (right lower corner and left lower corner in FIG. 9) of both right and left attachment portions 60, 60 are divided into multiple triangular or trapezoidal regions by one or multiple perforations 14, and the tip ends are removable in a triangular shape along the perforations 14. By cutting off triangular portions of both right and left attachment portions 60, 60 near tip ends thereof, it is possible to prevent exposure of the tip ends of both right and left attachment portions 60, 60 from the edge of the skirt.

(Effects)

Next, effects of the blind 1B for a skirt of Example 3 will be listed.

(1) The blind 1B for a skirt of Example 3 described above is configured of the flat sheet material 10, and integrally includes: the V-shaped blind portion 50 folded along the first folding line 11 and formed into a V shape so as to extend along right and left thighs, and also folded along the right and left second folding lines 12, 12 tilted relative to the first folding line 11 to shield a space formed between the V shape; and the right and left attachment portions 60, 60 formed to be continuous with the V-shaped blind portion 50 and attached to a skirt. The multiple right and left second folding lines 12, 12 extend (radially) from an intersection with the first folding line 11 toward the same one side forming the external shape of the flat sheet material. With the above configuration, the blind 1B can be attached and detached to and from the center inner face of the skirt. Hence, the blind 1B can be used by anyone wearing the skirt, and the blind 1B can be placed in any desired position.

Additionally, by varying the distance between the attachment portions 60, 60 and the relative angle (degree of opening) between the attachment portions 60, 60 according to need of the user, the height (depth), width, length, and the like of the V-shaped blind portion 50 can be varied freely. Hence, the blind 1B can be changed into and adapted to various shapes in a single form.

In addition, the attachment portion 60 can be attached multiple times. Since the blind 1B can be replaced immediately when the user sweats during use, for example, odor is less likely to stick to the blind 1B, skin disease is less likely to occur, and the blind 1B can be kept clean.

Moreover, since all of the used materials are inexpensive, the blind 1B can be mass-produced as a disposable and inexpensive product. Further, the blind 1B is hidden in a standing state, and forms a blind in a sitting state.

In the present invention, the blind 1B for a skirt appears natural in an attached state when viewed from the front.

Furthermore, since the blind 1B is formed by folding the flat sheet material 10, production is easy and various materials are usable. Hence, the blind 1B is inexpensive, easy to carry, and is therefore easily changeable.

In particular, the right and left second folding lines 12 extend from the intersection with the first folding line 11 toward the same one side forming the external shape of the flat sheet material, so that the V-shaped blind portion 50 is formed closer to the back of the blind 1B in the attached state, it is possible to prevent the part of the V-shaped blind portion 50 near the tip end from protruding to the outside of the skirt.

(2) Additionally, the right and left attachment portions 60, 60 have an adhesive and a release paper covering the face on which the adhesive is applied. The release paper is a single piece or is divided into multiple regions, so that the region where the release paper is not peeled is also usable (usable) as the V-shaped blind portion 50. Hence, sizes of the attachment portion 60 and the V-shaped blind portion 50 can be adjusted according to the body size and preferences.

(3) Additionally, the tip ends of the right and left attachment portions 60, 60 are divided into multiple triangular or trapezoidal regions by one or multiple perforations 14, . . . , and the tip ends are removable along the perforations 14, . . . . By cutting off the tip end parts and adjusting size, it is possible to prevent exposure of the tip ends of the right and left attachment portions 60, 60 from the edge of the skirt.

Figure 10:
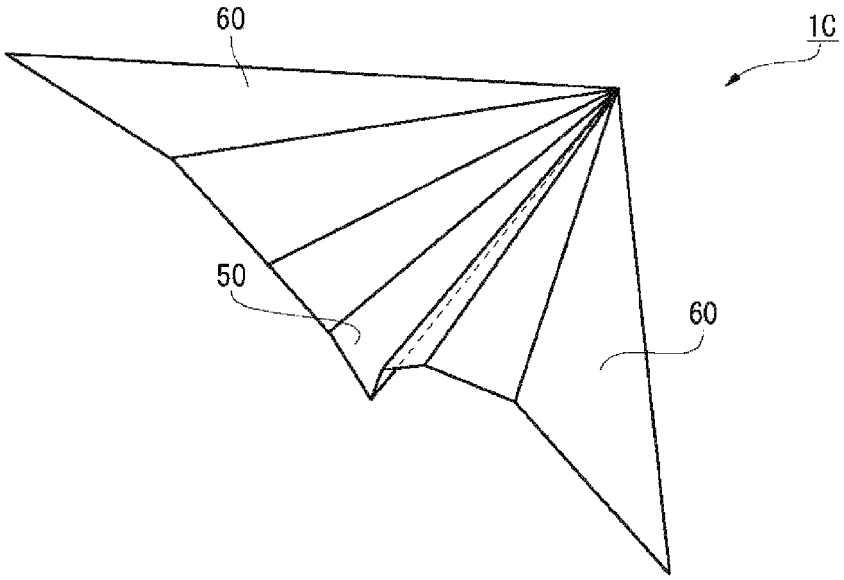
FIG. 10 is a perspective view of a blind for a skirt of a modification.
Figure 11:
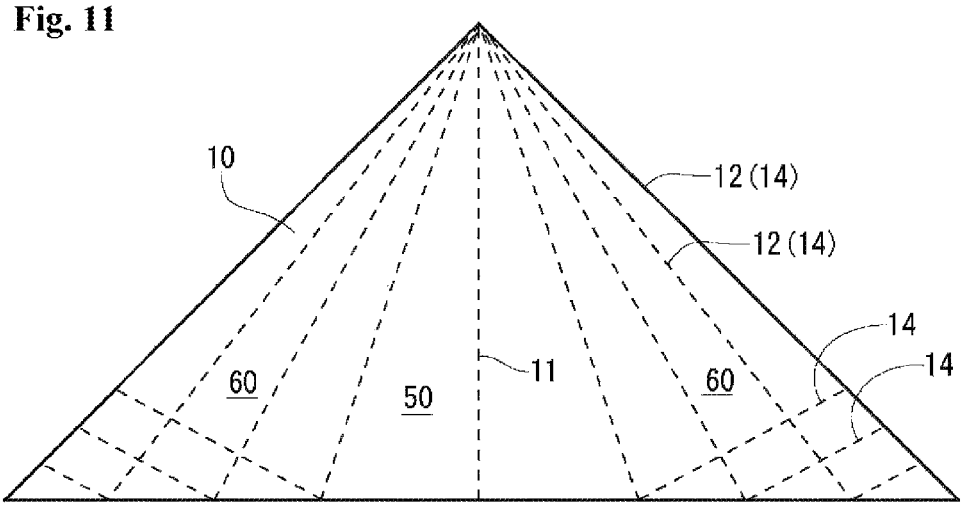
FIG. 11 is a plan view of the blind for a skirt of the modification.

Instead, as shown in a modification of FIGS. 10 and 11, a blind 1C for a skirt is preferably formed of a triangular sheet material 10. That is, as compared to the blind 1B for a skirt of FIG. 9, the blind 1C of a skirt of FIG. 11 is preferably formed into a triangular shape (or an isosceles triangle or an isosceles right triangle) as a whole, by removing regions (attachment portion 60) outside the outermost second folding lines 12 in FIG. 9. In other cases, the flat sheet material may be formed into any flat shape such as a trapezoid, a pentagon, a hexagon, a circular shape, and an elliptical.

Note that since other configurations and effects are substantially the same as Examples 1 and 2, descriptions will be omitted.

Example 4

Next, Example 4 will be described with reference to FIGS. 12 and 13. Note that descriptions of parts same or similar to those of Examples 1 to 3 are given by assigning the same reference numerals.

(Configuration)

Figure 12:
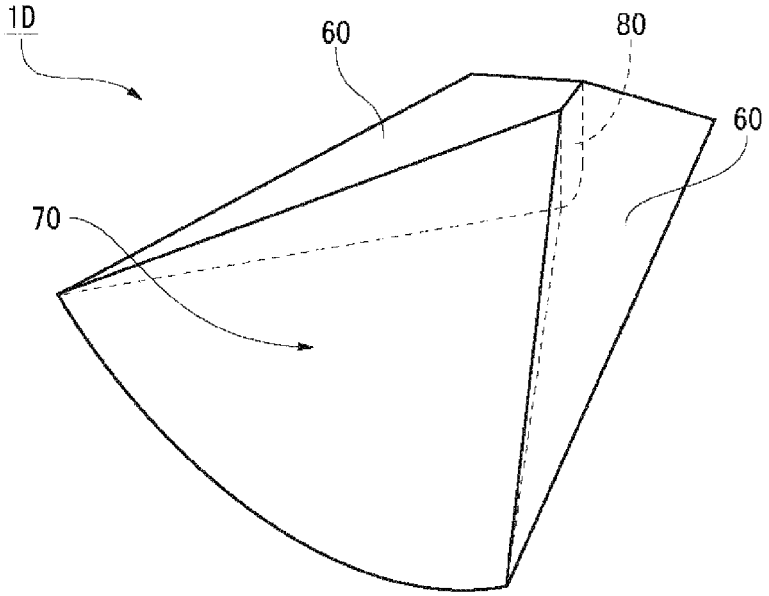
FIG. 12 is a perspective view of a blind for a skirt of Example 4.
Figure 13:
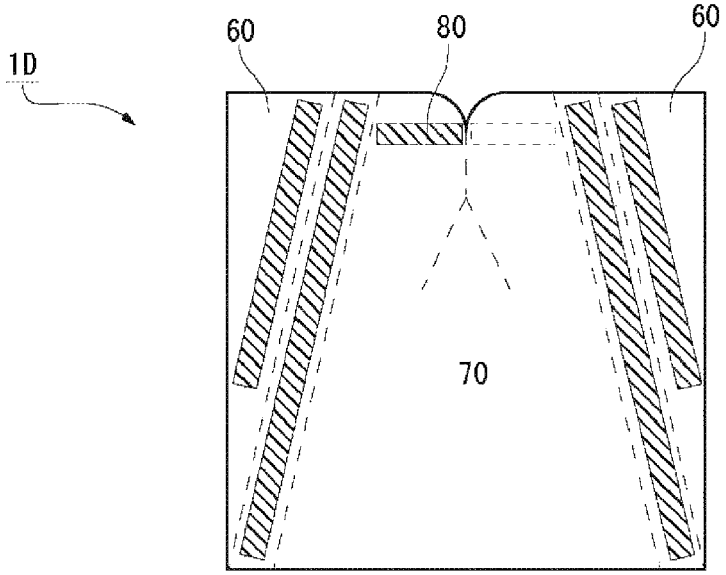
FIG. 13 is a plan view of the blind for a skirt of Example 4.

As shown in FIGS. 12 and 13, a blind 1D for a skirt of Example 4 is configured of a substantially square sheet material. The blind 1D integrally includes: a joint portion 80 where a first portion and a second portion are folded on one another and joined in a linear form; and attachment portions 60, 60 folded back to the right and left so as to form a plane intersecting with the linearly joined joint portion 80.

The joint portion 80 is a part where a left half (first portion) of a border, which is a midpoint of a side, and a right half (second portion) of the border are folded on top of one another and joined in a linear form. An adhesive and a release paper covering a face on which the adhesive is applied are provided in the joint portion 80. Parts of the joint portion 80 that form corners in the joined state should preferably be chamfered into a fan shape. Note that the joint portion 80 may be joined beforehand by press-fitting or other methods in a factory.

Then, a blind portion 70 spreads in a fan shape with the joint portion 80 placed in a pivot position of the fan shape. In this case, although a center crease (first folding line in aforementioned examples) is not particularly necessary, perforations near the joint portion 80 may serve as a borderline to facilitate folding of the right and left sides.

Sides of the right and left attachment portions 60, 60 far from the joint portion 80 are spaced apart from each other to be attached to a skirt S in an inverted V shape. That is, the attachment portion 60 has an adhesive and a release paper covering the face on which the adhesive is applied. The release paper is a single piece or is divided into multiple regions, so that the region where the release paper is not peeled is also usable (usable) as the blind portion 70.

(Effects)

Next, effects of the blind 1D for a skirt of Example 4 will be listed.

(1) As described above, the blind 1D for a skirt of Example 4 is configured of a flat sheet material, and integrally includes: the joint portion 80 where a first portion and a second portion are folded on one another and joined in a linear form; and the attachment portions 60, 60 folded back to the right and left so as to form a plane intersecting with the linearly joined joint portion 80. Sides of the right and left attachment portions 60, 60 far from the joint portion 80 are spaced apart from each other to be attached to the skirt in an inverted V shape. Thus, the blind 1D can be attached and detached to and from the center inner face of the skirt. Hence, the blind 1D can be used by anyone wearing the skirt, and the blind 1D can be placed in any desired position.

Additionally, by varying the distance between the attachment portions 60, 60 and the relative angle (degree of opening) between the attachment portions 60, 60 according to need of the user, the height (depth), width, length, and the like of the blind portion 70 can be varied freely. Hence, the blind 1D can be changed into and adapted to various shapes in a single form.

In addition, the attachment portion 60 can be attached multiple times. Since the blind 1D can be replaced immediately when the user sweats during use, for example, odor is less likely to stick to the blind 1D, skin disease is less likely to occur, and the blind 1D can be kept clean.

Moreover, since all of the used materials are inexpensive, the blind 1D can be mass-produced as a disposable and inexpensive product. Further, the blind 1D is hidden in a standing state, and forms a blind in a sitting state.

(2) Additionally, the right and left attachment portions 60, 60 have an adhesive and a release paper covering the face on which the adhesive is applied. The release paper is a single piece or is divided into multiple regions, so that the region where the release paper is not peeled is also usable (usable) as the blind portion 70. Hence, sizes of the attachment portion 60 and the blind portion 70 can be adjusted according to the body size and preferences.

(3) Additionally, the right and left attachment portions 60, 60 are divided into multiple regions by one or multiple perforations, and the attachment portion 60 is removable along the perforations 14. Hence, by cutting off and removing unnecessary parts, a light and simple blind 1D can be obtained.

Note that since other configurations and effects are substantially the same as Examples 1 to 3, descriptions will be omitted.

Although embodiments of the present invention have been described in detail based on Examples 1 to 4 with reference to the drawings, specific configurations are not limited to Examples 1 to 4, and design changes within the gist of the invention are included in the invention.

For example, although the above Examples 1 to 4 describe cases where an adhesive is applied to the attachment portion 40, 60, the invention is not limited to this. The attachment portion may be formed of a hook-and-loop fastener, so that one is attached to the attachment portion side and the other is attached to the skirt side. In this case, the side attached to the skirt may be adhered or may be sewn to be fixed. Also in this case, by attaching a hook-and-loop fastener having a larger area than the attachment portion 40, 60 of the blinds 1 to 1D on the skirt side, it is possible to adjust the position, height (depth), degree of opening, and the like of the blinds 1 to 1D according to needs of the user. For example, a hook-and-loop fastener having about the same area as the blinds 1 to 1D may be used on the skirt side. Moreover, when sweat or the like attaches, the blind 1 to 1D may be replaced, washed, and be reused if necessary.

Further, although the blind portion 30 and the V-shaped blind portion 50 do not contain a special component in the above Examples 1 to 4, the invention is not limited to this, and scent of a perfume or a mosquito screening component may be contained as an option. Moreover, a moisturizing component or a nutrient may be contained.

Although not particularly described in above Examples 1 to 4, various colors may be added to the blinds 1 to 1D for a skirt. For example, the color of the skirt S or the color of stockings may be added.

Figure 7:
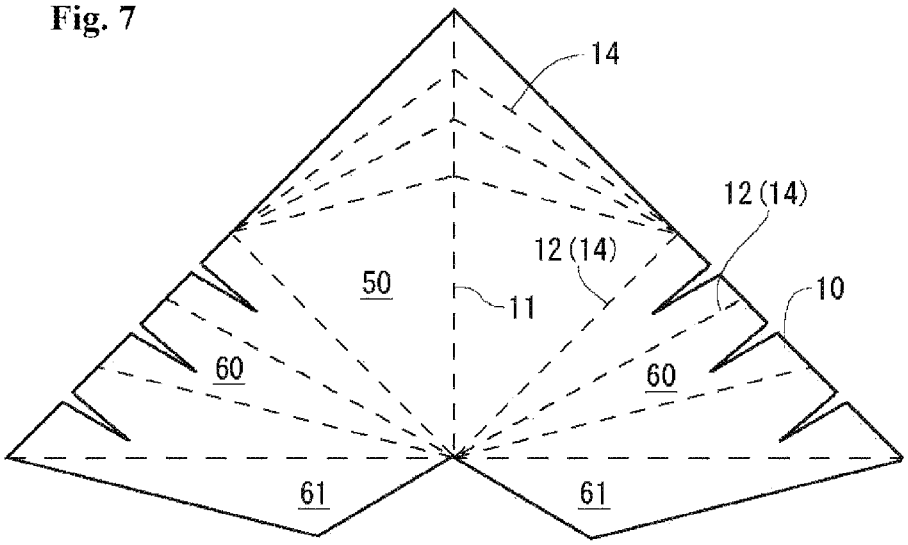
FIG. 7 is a plan view of a blind for a skirt of a modification.

Additionally, as shown in the modification of FIG. 7, an enlarged portion 61 may be provided adjacent to the attachment portion 60 to enhance adhesive force of the attachment portion 60. Note that the shape and position of the enlarged portion 61 is not limited to the example, and may be in any form. In addition, a slit may be formed on the outer edge of the attachment portion 60.

Figure 4:
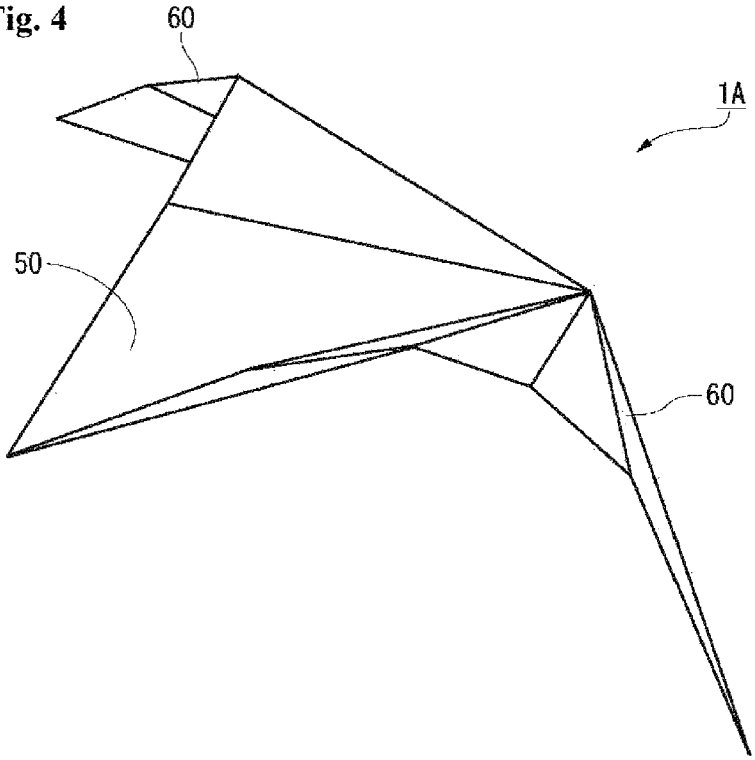
FIG. 4 is a perspective view of a blind for a skirt of Example 2.
Figure 5:
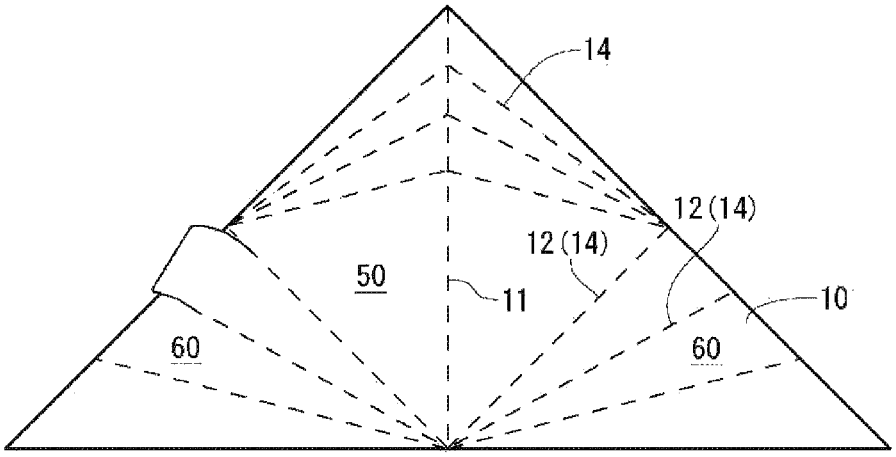
FIG. 5 is a plan view of the blind for a skirt of Example 2.

Further, in Example 1, the left side of FIG. 1 is described as the front (front side), and in Example 2, the left side of FIG. 4 is described as the front (front side). However, the invention is not limited to this, and the blinds may be attached to the skirt S in a reversed manner according to the user's preference. The blind can similarly be attached to the skirt in a reversed manner in Example 3.

Additionally, although Examples 1 to 4 describe cases where examples of the sheet material 10 include chemical fiber such as acryl, polyester, and nylon, natural fiber such as cotton and hemp, nonwoven fabric, felt, Japanese paper, and foreign paper, the invention is not limited to this. A material having a certain stretchability may be used so that the blind may follow the deformation of the skirt S. The material of the blind is not limited to a specific material.

Additionally, although not particularly descried in Examples 1 to 4, the sheet material 10 may be distributed in a flat form, or may be distributed by being pre-formed into a three-dimensional shape by stamping or pressure forming in a factory.

REFERENCE SIGNS LIST

1, 1A blind for a skirt
1B, 1C, 1D blind for a skirt
10 sheet material
11 first folding line
12 second folding line
13 third folding line
14 perforations
20 V-shaped portion
30 blind portion
40 attachment portion
50 V-shaped blind portion
60 attachment portion
70 blind portion
80 joint portion

The invention claimed is:

1. A blind for a skirt configured of a flat sheet material integrally comprising:
a V-shaped portion folded along a first folding line and formed so as to extend along right and left thighs;
a blind portion folded along right and left second folding lines tilted relative to the first folding line of the V-shaped portion to shield a space formed between the V-shaped portion; and
right and left attachment portions formed to be continuous with the V-shaped portion and attached to a skirt.

2. The blind for a skirt according to claim 1, wherein:
the right and left attachment portions have an adhesive and a release paper covering a face on which the adhesive is applied; and
the release paper is a single piece or is divided into a plurality of regions, so that a region where the release paper is not peeled is also usable as the V-shaped portion.

3. The blind for a skirt according to claim 1, wherein:
the right and left attachment portions are divided into a plurality of regions by one or a plurality of perforations; and
the attachment portions are removable along the perforations.

4. A blind for a skirt configured of a flat sheet material integrally comprising:
a V-shaped blind portion folded along a first folding line and formed into a V shape so as to extend along right and left thighs, and also folded along right and left second folding lines tilted relative to the first folding line to shield a space formed between the V shape; and
right and left attachment portions formed to be continuous with the V-shaped blind portion and attached to a skirt.

5. The blind for a skirt according to claim 4, wherein:
the right and left attachment portions have an adhesive and a release paper covering a face on which the adhesive is applied; and
the release paper is a single piece or is divided into a plurality of regions, so that a region where the release paper is not peeled is also usable as the V-shaped blind portion.

6. The blind for a skirt according to claim 4, wherein:
the right and left attachment portions are divided into a plurality of regions by one or a plurality of perforations; and
the attachment portions are removable along the perforations.

7. The blind of a skirt according to claim 4, wherein:
a tip end of the V-shaped blind portion is divided into a plurality of regions by one or a plurality of perforations; and
the tip end is removable along the perforations.

8. A blind for a skirt configured of a flat sheet material integrally comprising:
a V-shaped blind portion folded along a first folding line and formed into a V shape so as to extend along right and left thighs, and also folded along right and left second folding lines tilted relative to the first folding line to shield a space formed between the V shape; and right and left attachment portions formed to be continuous with the V-shaped blind portion and attached to a skirt, wherein the right and left second folding lines extend from an intersection with the first folding line toward the same one side forming an external shape of the flat sheet material.

9. The blind for a skirt according to claim 8, wherein:

the right and left attachment portions have an adhesive and a release paper covering a face on which the adhesive is applied; and the release paper is a single piece or is divided into a plurality of regions, so that a region where the release paper is not peeled is also usable as the V-shaped blind portion.

10. The blind for a skirt according to claim 8, wherein:

tip ends of the right and left attachment portions are divided into a plurality of regions by one or a plurality of perforations; and the tip end is removable along the perforations.

11. A blind for a skirt configured of a flat sheet material integrally comprising:

a joint portion where a first portion and a second portion are folded on one another and joined in a linear form; and attachment portions folded back to the right and left so as to form a plane intersecting with the linearly joined joint portion, wherein sides of the right and left attachment portions far from the joint portion are spaced apart from each other to be attached to a skirt in an inverted V shape.

12. The blind for a skirt according to claim 11, wherein:

the right and left attachment portions have an adhesive and a release paper covering a face on which the adhesive is applied; and the release paper is a single piece or is divided into a plurality of regions, so that a region where the release paper is not peeled is also usable as the V-shaped portion.

13. The blind for a skirt according to claim 11, wherein the right and left attachment portions are divided into a plurality of regions by one or a plurality of perforations; and the attachment portions are removable along the perforations.

* * * * *